United States Patent [19]

Pfaff

[11] Patent Number: 4,825,739

[45] Date of Patent: May 2, 1989

[54] PUNCH SYSTEM FOR PERFORATING PLASTIC SHEETS

[75] Inventor: Douglas Pfaff, Bloomfield Hills, Mich.

[73] Assignee: Bernal, Inc., Oxford, Mich.

[21] Appl. No.: 631,187

[22] Filed: Jul. 16, 1984

[51] Int. Cl.[4] ..... B26D 7/18

[52] U.S. Cl. ..... 83/139; 83/658; 83/689

[58] Field of Search ..... 83/139, 689, 684, 686–688, 83/650, 685

[56] References Cited

U.S. PATENT DOCUMENTS

| | | | |
|---|---|---|---|
| 356,113 | 1/1887 | Forbes | 83/658 |
| 553,715 | 1/1896 | Long et al. | 83/658 |
| 2,214,701 | 9/1940 | Scull | 83/689 |
| 2,815,814 | 12/1957 | Taylor | 83/139 |
| 3,130,885 | 4/1964 | Fleming | 83/689 |
| 3,656,394 | 4/1972 | McCutcheon | 83/689 |
| 3,850,064 | 11/1974 | Dwyer | 83/139 |

FOREIGN PATENT DOCUMENTS

| | | | |
|---|---|---|---|
| 222625 | 6/1958 | Australia | 83/139 |

*Primary Examiner*—Frank T. Yost
*Assistant Examiner*—Tom Hamill, Jr.
*Attorney, Agent, or Firm*—Krass & Young

[57] ABSTRACT

A punch system for rigid and brittle plastic sheet materials such as polycarbonates comprising a punch body mounted in a carrier board and having an upwardly projecting head portion which defines the shape of the hole to be punched, a ring of high durometer urethane mounted on the punch head to serve as a stabilizer and stripper and a disk of high durometer urethane mounted on the under surface of the press platen directly opposite the punch to receive the punch head and the slug of punched material during the punching operation. The punch is used in combination with a steel rule die but can be used either with other punches or alone.

5 Claims, 1 Drawing Sheet

PUNCH SYSTEM FOR PERFORATING PLASTIC SHEETS

INTRODUCTION

This invention relates to apparatus for punching holes in relatively thin sheets of rigid plastics such as polycarbonates. In particular, the invention contemplates the construction of a die which includes punch components either alone or in combination with steel rule elements for cutting specified shapes.

BACKGROUND OF THE INVENTION

Dies and punches for cutting and punching various material such as cardboard and plastic sheets are well known. Typical applications include mass production of display cards, instrument faces, semi-transparent film strips and backing materials. Typically a punch comprises a steel body having a work-engaging punch surface which is hollowed out to define a peripheral cutting edge and filled in the hollowed out portion with spongy material to eject the slug of punched material. These punches are relatively difficult and expensive to make, particularly in very small sizes.

A problem arises in the punching of holes in relatively rigid plastic sheets such as polycarbonates. These materials have a tendency to crack or spall during the punching operation and the application of conventional techniques has not been satisfactory.

SUMMARY OF THE INVENTION

The present invention comprises an apparatus which is particularly adapted for punching holes in sheets of relatively rigid plastic materials such as polycarbonates, polyethylene, polyurethane and the like. The apparatus typically comprises a punch carrier such as a backing board, and a punch body which is mounted in or on the carrier and which has a head portion which defines the shape of the hole to be punched and which extends away from the carrier. The head portion has a leading surface which is not hollowed out but which is planar in character. The head portion of the punch is surrounded by a stabilizer/stripper body of durable resilient material such as hard urethane to both stabilize the work just prior to entry of the punch head and also to strip the work off of the punch head upon retraction of the punch operating press. The apparatus finally comprises a pad which is mounted on a reaction surface opposite the punch head for receiving the head portion during the punching operation. The pad is also preferably made of a durable resilient material such as hard urethane.

The invention may be used for punching operations alone or in combination with steel rule cutting dies also mounted in the punch carrier board for cutting specific shapes and punching within said shapes at the same time.

DETAILED DESCRIPTION OF THE SPECIFIC EMBODIMENT

Figure 1:
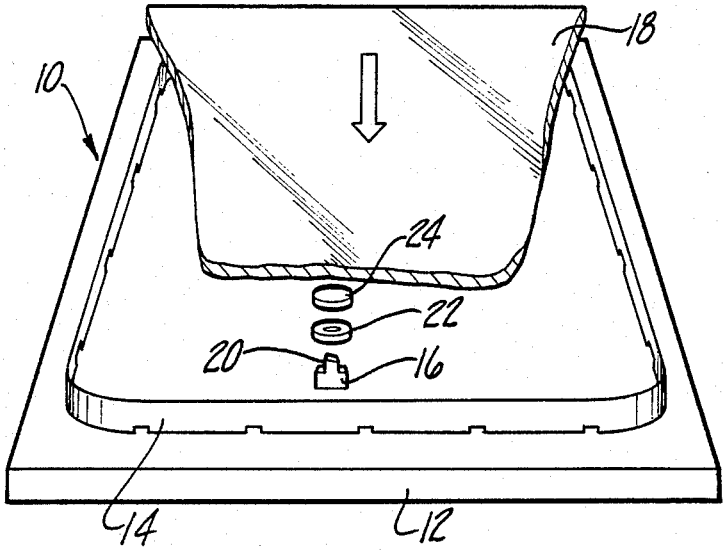
FIG. 1 is a perspective view of a combination die comprising both steel rule shape cutter portions and a punch portion end embodying the invention.

Looking first to FIG. 1, a die 10 comprises a plywood board 12 which serves as a carrier for a length of conventional steel die rule 14 which defines a closed shape and a steel punch 16 which lies within the shape. The die 10 is adapted to be operated by an upper press platen 18 which is actuated by mechanical, hydraulic or pneumatic means in the direction of the arrow to force a worksheet onto the upper sharpened edge of the die rule 14 and onto the head 20 of the punch 16 to cut out the shape defined by the rule 14 and to punch a hole defined by the shape of the head 20. The actuating means then reciprocally withdraws the upper platen 18 to release the material in conventional fashion.

Figure 2:
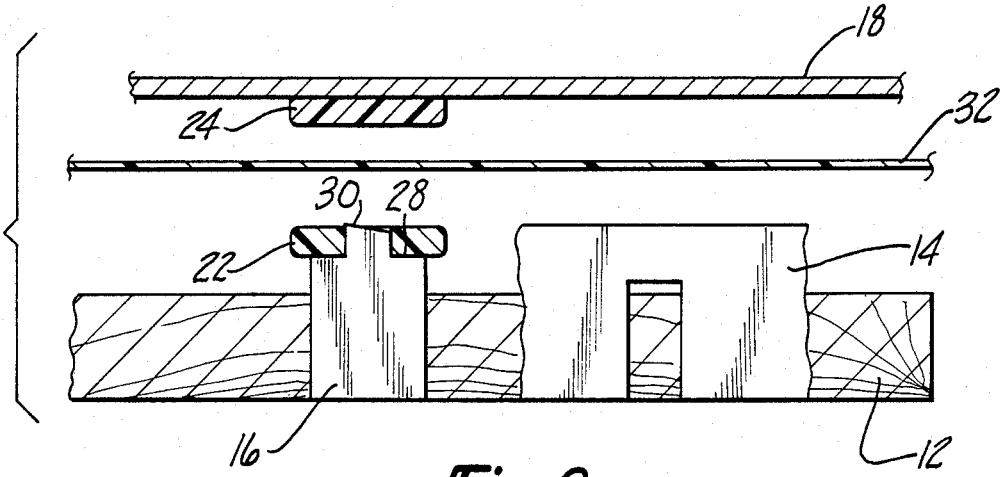
FIG. 2 is a side sectional view of a portion of the apparatus of FIG. 1 illustrating the dimensional relationships between the steel rule and punch portions thereof.

The assembly shown in FIG. 1 comprises, in addition to the elements thus far described, a ring or annulus of high density relatively hard but resilient urethane which, as better shown in FIG. 2, rests on the shoulders 28 of the punch 16 to surround the head 20 and act as a stabilizer and stripper. In addition, a pad 24 of disk shaped urethane is bonded to the underside of the platen 18 in alignment with the ring 22 to resiliently receive the head 20 of the punch 16 during the punch operation as hereinafter is described in detail with reference to FIGS. 3 and 4.

Looking now to FIG. 2, the die rule 14 and punch 16 are shown to be fully implemented in the carrier board 12 and also to rise to nearly the same height such that the upper portion of both the rule 14 and the punch 16 extend above the upper surface of the board 12. The head 20 of punch 16 is smaller than the body 16 in at least one dimension thereby to define the shoulders 28 which receive the stabilizer/stripper ring 22. Gaps 26 in die rule 14 create uncut "bridges" in board 12 so that the routed-out channel for the rule 14 can be discontinuous; this is required to maintain the integrity of board 12. The punch 16 exhibits a flat, non-hollow workpiece-engaging surface 30, the shape of which defines the shape of the hole to be punched and which exhibits a shear or angulation the total vertical excursion of which is at least approximately equal to the thickness of the plastic sheet 32 which forms the workpiece in the assembly of FIGS. 2–4. Selecting typical dimensions for purposes of illustration only, the total height of the steel die rule 14 may be 0.937 inches and the height from the bottom of the board 12 to the top of the ring 22 may be 0.907 inches. The thickness of the ring 22 is equal to the height of the head 20 and the thickness of the pad 24 is 0.060 inches. Ring 22 and pad 24 are preferably solid urethane with a durometer number of 90–100.

The board 12 is made of wood, the rule 14 and the punch 16 are made of steel and the upper platen 18 is also made of steel.

Figure 3:
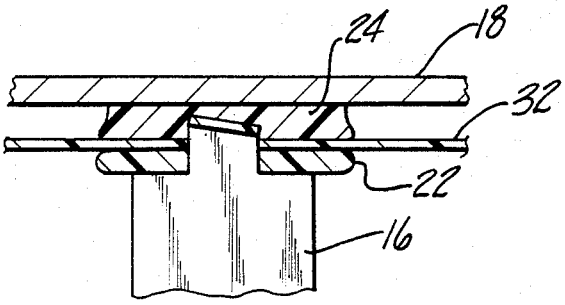
FIG. 3 is a side view partly in section of the punch, stripper/stabilizer and pad elements a the instant of full penetration of the punch through a sheet of plastic.
Figure 4:
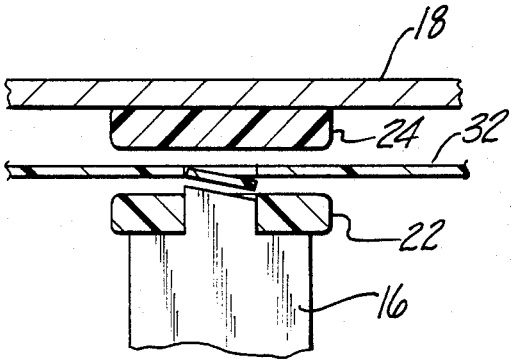
FIG. 4 illustrates the apparatus of FIG. 3 just after release of the punch due to opening of the punch press.

Looking now to FIGS. 3 and 4 a typical operation of the assembly will be described. As the platen 18 is driven vertically downwardly the plastic sheet 32 is forced onto the upper surface of the die rule 14 to cut the overall shape and also onto the head 20 of the punch 16. The ring 22 acts to stabilize the sheet material 32 as it meets the upper surface of the punch 16 and thereafter compresses as the sheet 32 is driven onto and through the punch head. The pad 24 compresses resiliently to receive the punch head 20 and also to receive the slug of plastic material which is removed from the sheet 32 as best shown in FIG. 3.

As the upper platen 18 is withdrawn the stabilizer/-stripper ring 22 rebounds to full height and strips the material 32 off of the punch head. The upper pad 24 also reexpands to full thickness and a neat cut and punch operation is performed without cracking or spalling of the relatively brittle sheet 32 of plastic material.

It is to be understood that the punch 16 together with the stabilizer/stripper ring 22 and the pad 24 may be used either alone or in combination with other similar punches or with the die rule 14 shown in FIGS. 1 and 2. The punch 16 may represent any shape according to the configuration of the head 20 according to the shape of the hole to be punched.

I claim:

1. Apparatus for punching holes in sheets of rigid plastic and the like comprising:

a punch carrier means;

a punch body carried by said carrier means and having a non-hollow head portion which projects away from said carrier means; said head portion having a planar, work-engaging leading surface the shape of which defines the shape of the punched hole;

a ring of compressible material mounted surroundingly on the head portion of said punch body substantially flush with the work-engaging surface and leaving said work-engaging surface exposed;

a pad of compressible material mounted opposite said punch for receiving said head portion of the punch body and the punched material from the work when the punch head portion is urged through the work and into said pad; and said ring and said pad being composed of a durable resilient material which is substantially more compressible than the material to be punched so as to be compressed during a punching operation but return to original dimension thereafter.

2. Apparatus as defined in claim 1 wherein said pad is mounted on a press platen which supplies mechanical force for urging the workpiece onto the work-engaging surface and for performing the punching function.

3. Apparatus as defined in claim 1 wherein said work-engaging surface exhibits a shear the vertical excursion of which is at least approximately equal to the thickness of the work sheet.

4. Apparatus as defined in claim 1 wherein the ring and said pad are composed of high durometer urethane.

5. Apparatus as defined in claim 1 further including a length of steel die rule carried by said punch carrier means and operable in combination with said punch body.

* * * * *